United States Patent [19]

Chang

[11] 4,250,843

[45] Feb. 17, 1981

[54] ENGINE WITH REVOLUTIONARY INTERNAL-COMBUSTION UNIT AND COMPRESSION RATIO AUTO-CONTROLLED DEVICE

[76] Inventor: Shiunn C. Chang, 18 Cherng Hwang La., Hwa Nan Sub-ward, Chang Hua City, Taiwan

[21] Appl. No.: 935,845

[22] Filed: Aug. 22, 1978

[51] Int. Cl.[3] ..... F02B 57/00

[52] U.S. Cl. ..... 123/43 AA; 91/499; 92/12.2; 417/274

[58] Field of Search ..... 123/43 A, 43 AA, 45 R, 123/45 A, 58 AA, 48 R; 417/269, 270, 274; 91/499, 500; 92/12.2

[56] References Cited

U.S. PATENT DOCUMENTS

| | | | |
|---|---|---|---|
| 1,569,525 | 1/1926 | Owens | 123/43 AA |
| 1,793,107 | 2/1931 | Livingston | 123/58 AA X |
| 3,249,052 | 5/1966 | Karlak | 92/12.2 X |
| 3,807,370 | 4/1974 | Baugh | 123/43 AA X |

FOREIGN PATENT DOCUMENTS

| | | | |
|---|---|---|---|
| 762148 | 1/1934 | France | 123/43 AA |

*Primary Examiner*—Michael Koczo, Jr.

*Attorney, Agent, or Firm*—Cushman, Darby & Cushman

[57] ABSTRACT

An engine internal-combustion engine having cylinders secured symmetrically spaced on a wheel rotor equipped with a main shaft and with their piston rods extending outwardly against a substantially saddle-shaped cam. The operation of the engine will make the reciprocating piston rods confront the undulating top surface of the cam and therefore revolve the internal-combustion cylinders themselves together with the wheel rotor along the undulating surface. The invention also includes an oil pressure cam receiver to cushion the cam confronting the piston rods and push the pistons to their maximum inward position in the cylinder to achieve a desired compression ratio of the fuel-air mixture in the combustion chamber of the cylinder.

4 Claims, 10 Drawing Figures

Fig. 3
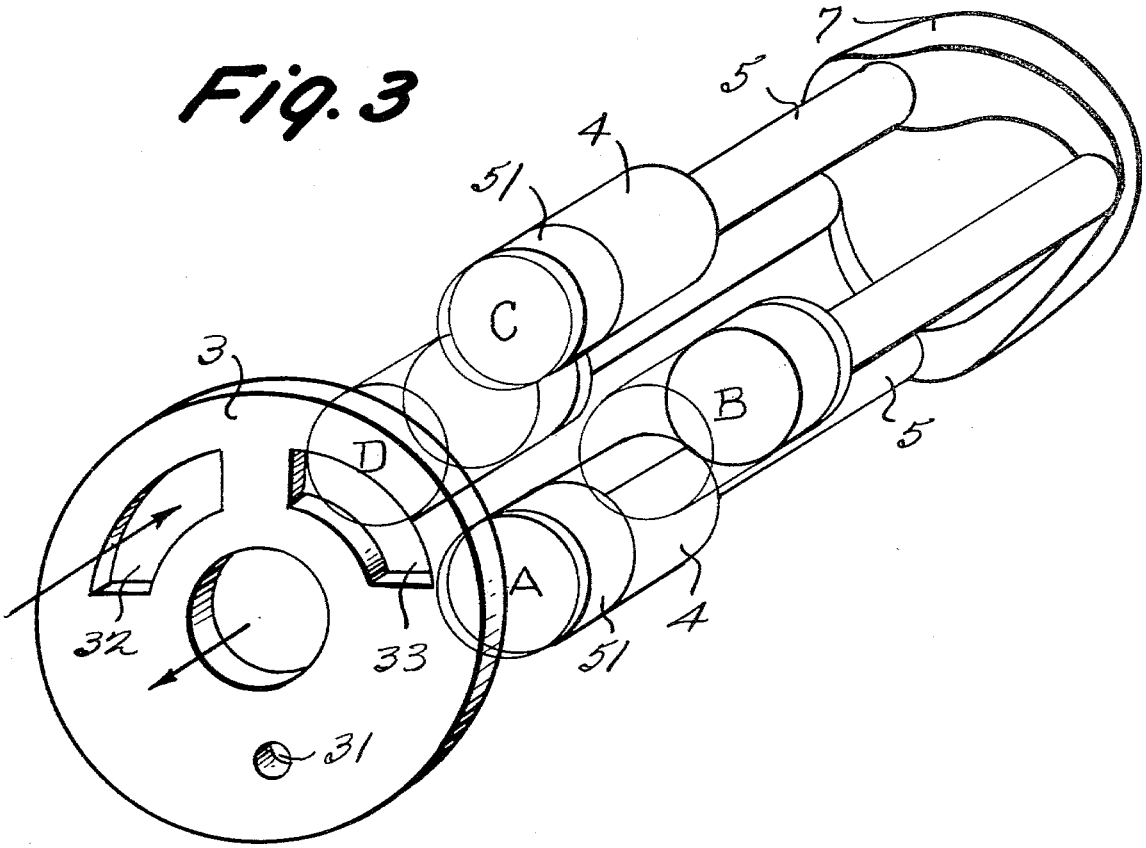
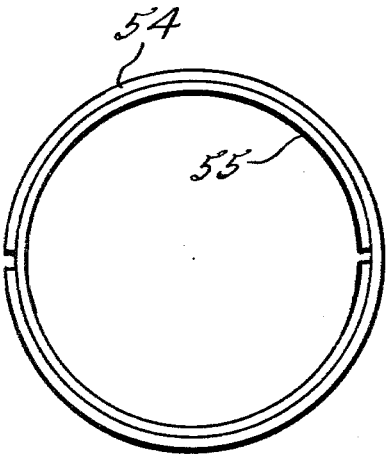
Fig. 4a
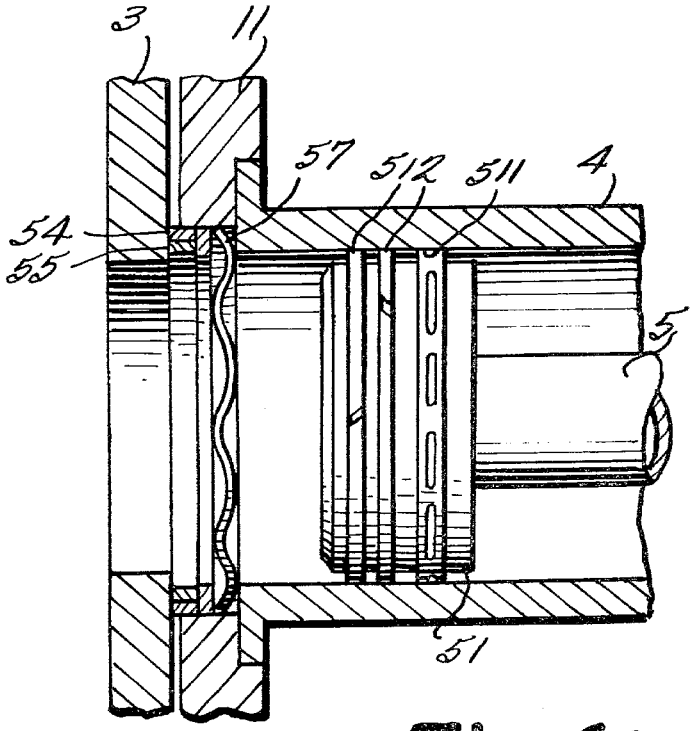
Fig. 4b

Fig. 5
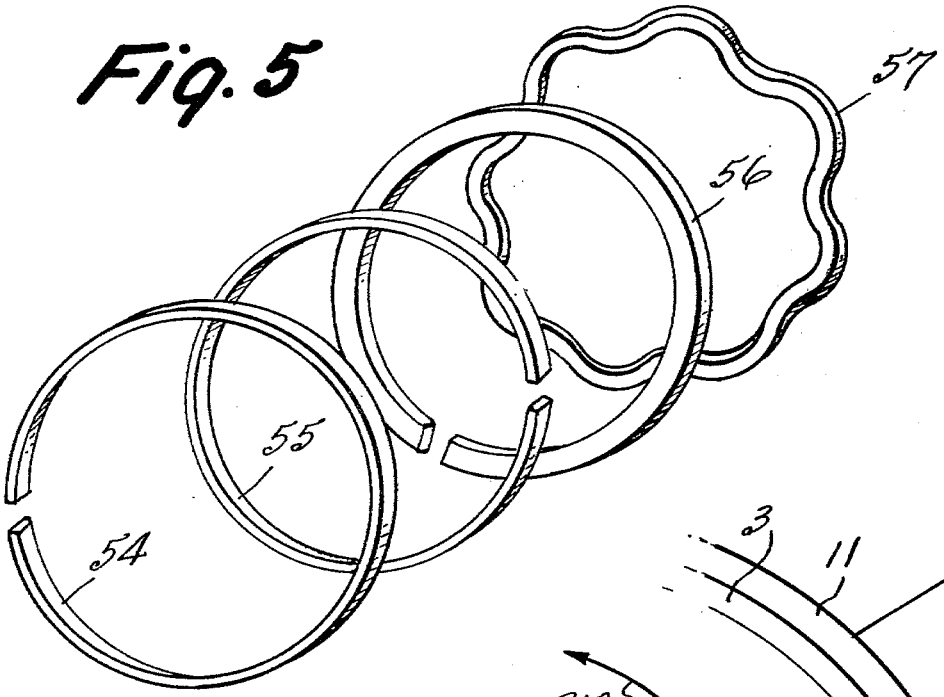
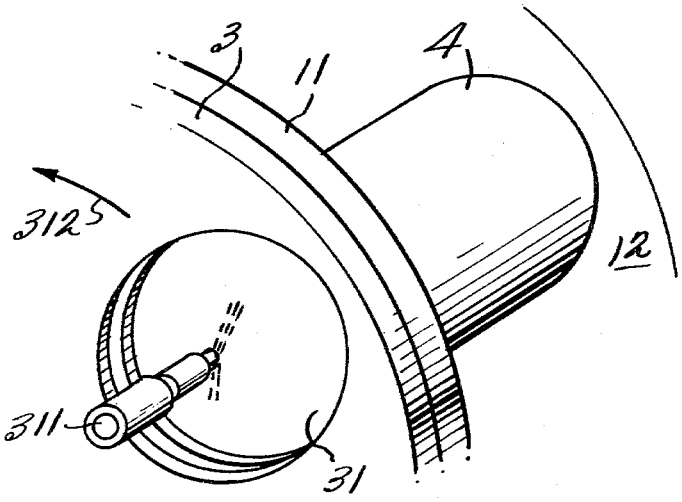
Fig. 6
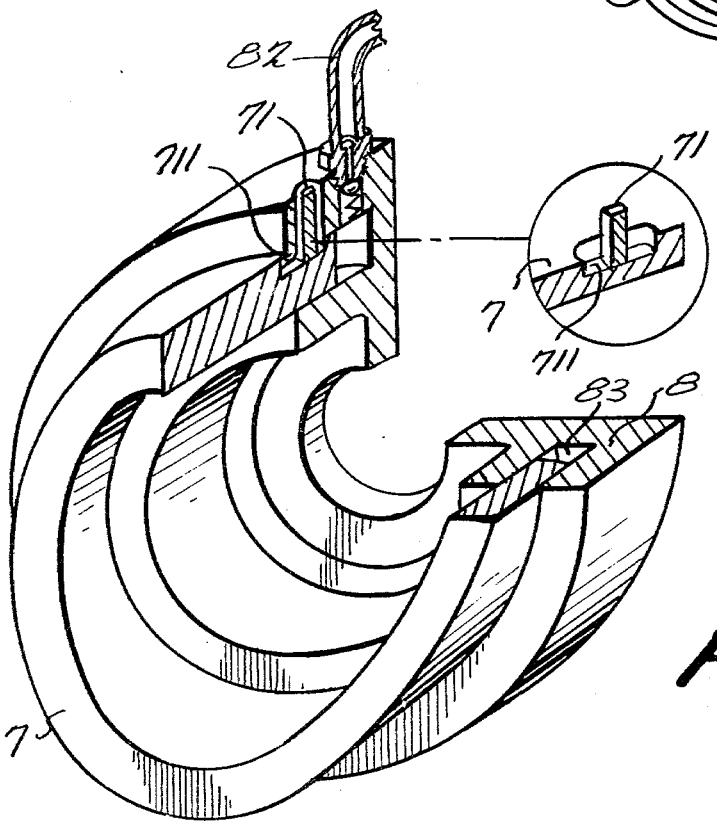
Fig. 7

ENGINE WITH REVOLUTIONARY INTERNAL-COMBUSTION UNIT AND COMPRESSION RATIO AUTO-CONTROLLED DEVICE

BACKGROUND

So far as is known there has not been developed any form of engine in which the cylinder is driven to revolve. There may be a so-called rotary engine (Wankel engine) in which gas turns a triangular-shaped rotor to rotate a main shaft with respect to a stationary housing. The rotary engine is unlike the present invention engine in which a rod reciprocates against an undulating cam surface to revolve the cylinder itself together with a wheel rotor having a center main shaft. A Wankel engine can be called a Rotary Engine; the present invention engine might be called a Revolving Engine. No form of engine with an automatic compression ratio adjustable undulating saddle-shaped cam employed in the present invention is known to have been previously developed.

SUMMARY OF THE INVENTION

The present invention discloses several spark-ignition engine cylinders (gasoline engine cylinders) or compression-ignition engine cylinders (diesel engine cylinders) secured vertically to and symmetrically on equal parts of a wheel rotor, with one piston rod in each of the cylinders confronting against an undulating cam surface of a substantially saddle-shaped cam received inside a base receiver.

A side housing, having bored therethrough an exhaust opening, an intake opening and a spacing hole of a fuel injection nozzle if a compression-ignition engine is employed) or a sparkplug (if a spark-ignition engine is employed), closely and turnably covers the top port of each cylinder to control the "induction," "ignition" and "exhaust" during operation of the engine of the present invention. When an engine of the present invention is operated by a starting motor, the cylinders therefore revolve and successively face the intake opening, the spacing hole and the exhaust opening of the side housing and in cooperation with the different travel positions of the piston inside the cylinder, each cylinder acts successively in four stages which may be identified as "induction," "compression," "power" and "exhaust," and therefore drives the piston rod to confront against the undulating cam surface and makes the cylinder itself revolve and cause the wheel rotor to do work.

The present invention can, moreover, be illustrated by comparing it to a Wankel engine. In a Wankel engine, the "compression," "power," "exhaust" and "intake" stages take place successively in each of three chambers during a single revolution of the rotor. In the present invention, the "compression," "power", "exhaust" and "intake" stages take place successively in each of four phases caused from the piston rod confronting the cam surface during a single revolution of the engine.

A base receiver is employed in the present invention with an oil ditch receiving the substantially saddle-shaped cam, and with certain high pressure oil conducting into the oil ditch and an oil pressure relief device in the ditch for cooperatively controlling the oil pressure in the ditch. These oil pressure control means suitably lift the cam and maintain the fixed maximum piston inward position. An utmost compression ratio of gas in the cylinder may therefore be kept.

The rotary engine (Wankel engine) has been used for years and practicable in wide fields. The revolving engine of the present invention can also be expected to be used at least in some special fields. But there is one advantage of the present invention engine that a rotary engine can not achieve. The rotary engine operates on the Otto Cycle and is a kind of spark-ignition engine but the present invention engine can appear both as a spark-ignition engine and as a compression-ignition engine.

Another main advantage of the present invention engine is that the revolving internal-combustion unit of the present invention engine improves the cooling of the engine itself. The present invention at least can compensate for some energy loss in revolution from that provided by the cooling system of a conventional engine.

DETAILED DESCRIPTION OF THE INVENTION

Other objects and structure of the invention will become apparent from a consideration of the following description and claims when considered in connection with the accompanied drawings, in which:

FIG. 3 is a perspective view of the invention showing the configuration of the side housing, internal-combustion unit and the substantially saddle-shaped orbit base;

Figure 8:
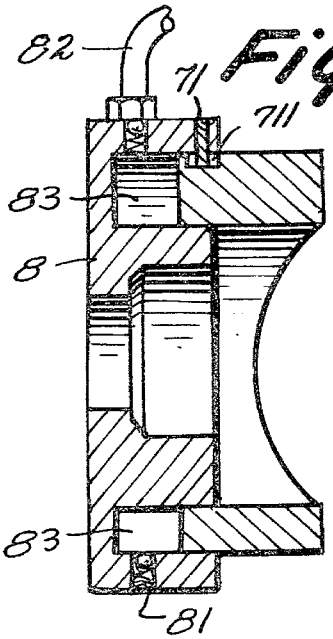
Figure 9:
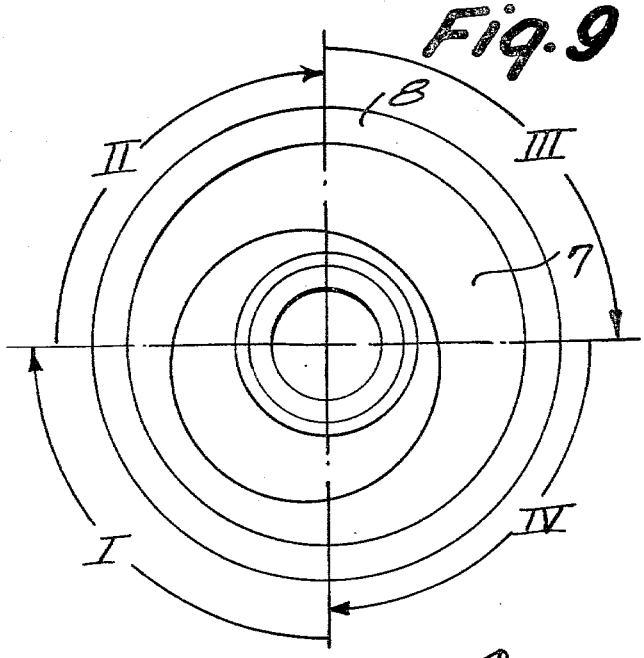
Figure 10:
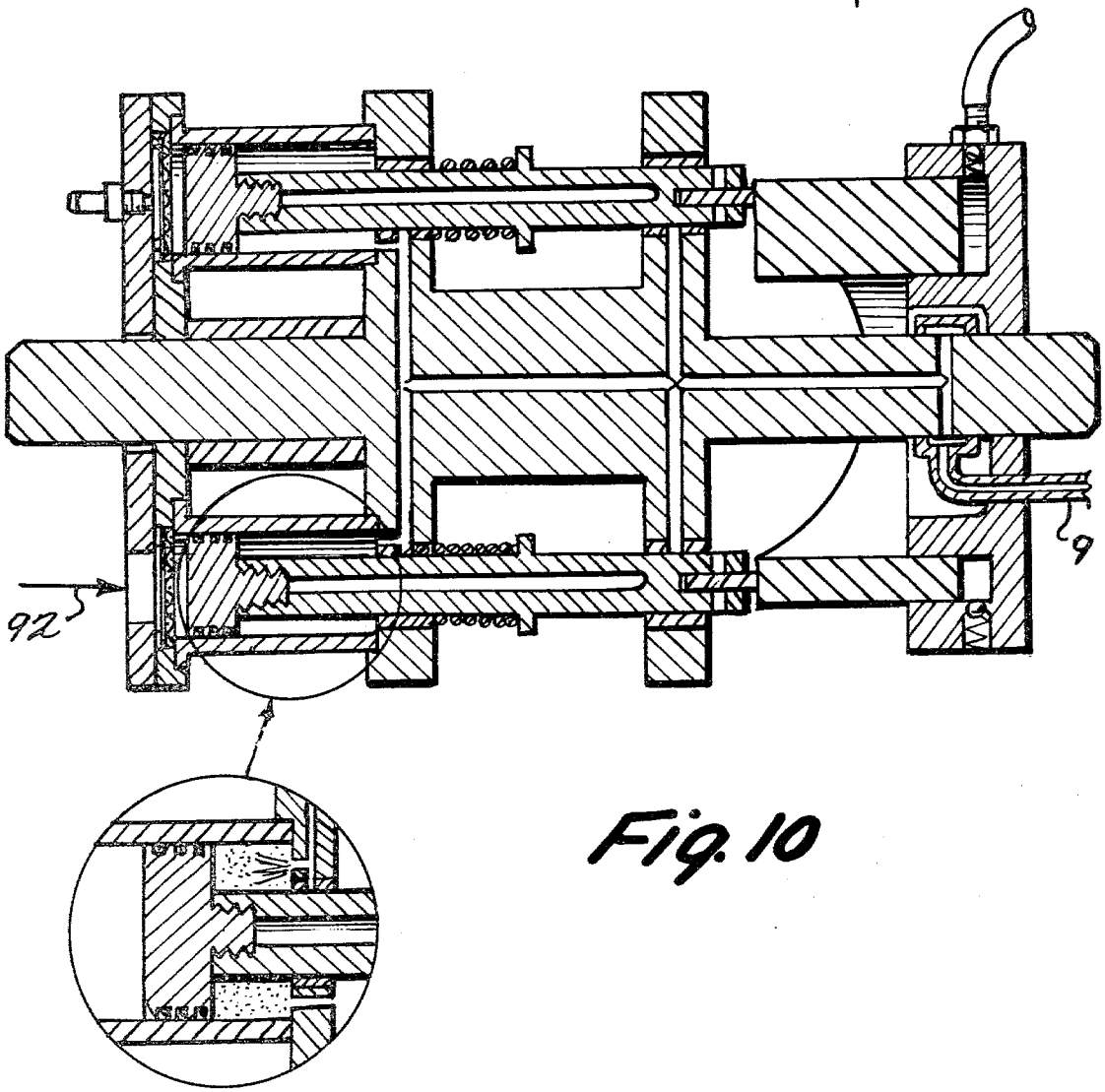

FIGS. 4*a* and 4*b* are respectively end and side sectional views of the top port of the present cylinder onto the base housing;

FIG. 5 is an exploded perspective view of the present invention packings employed in the top port of the invention cylinder;

FIG. 6 is a perspective view of the present invention showing a fuel injection nozzle in the spacing hole of the invention side housing;

FIG. 7 is a perspective view of the invention showing the substantially saddle-shaped cam and the cam receiver partly cut away;

FIG. 8 is a side sectional view of the elements of the invention shown in FIG. 7;

FIG. 9 is a top view of the elements of the invention shown in FIG. 7; and FIG. 10 shows the oil lines of the lubricating system of the present invention.

Figure 1:
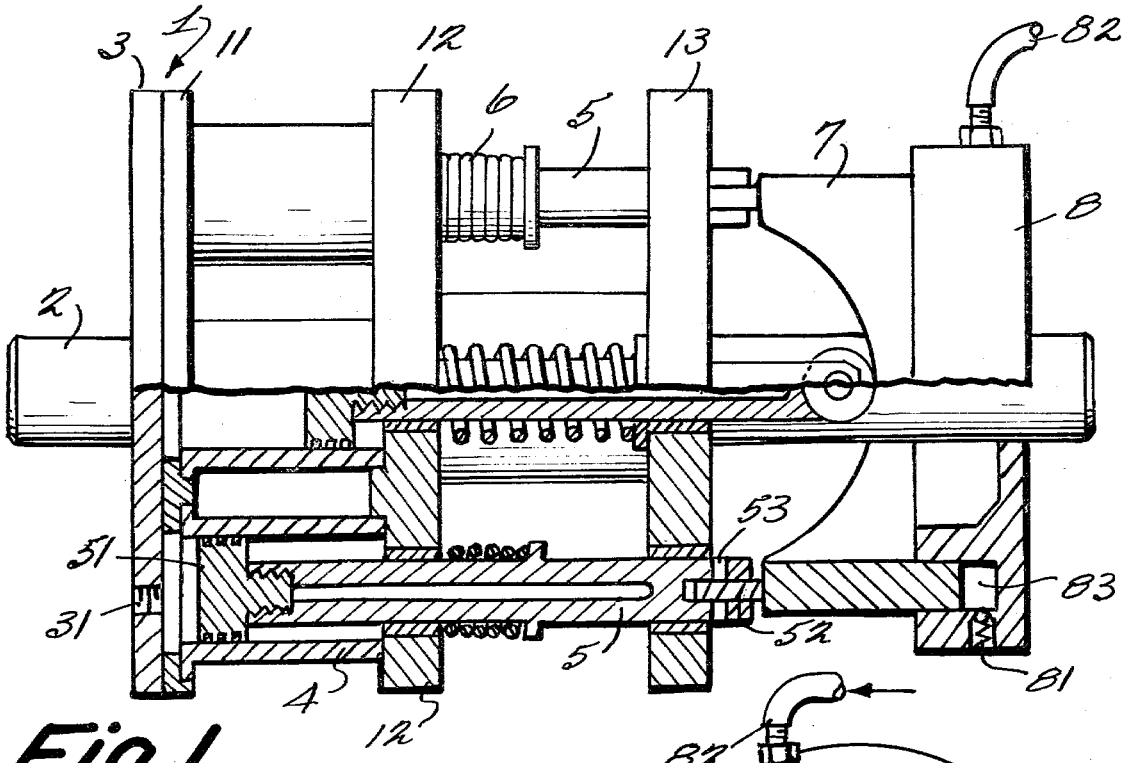
FIG. 1 is a side elevational view of the present invention partly cut away.
Figure 2:
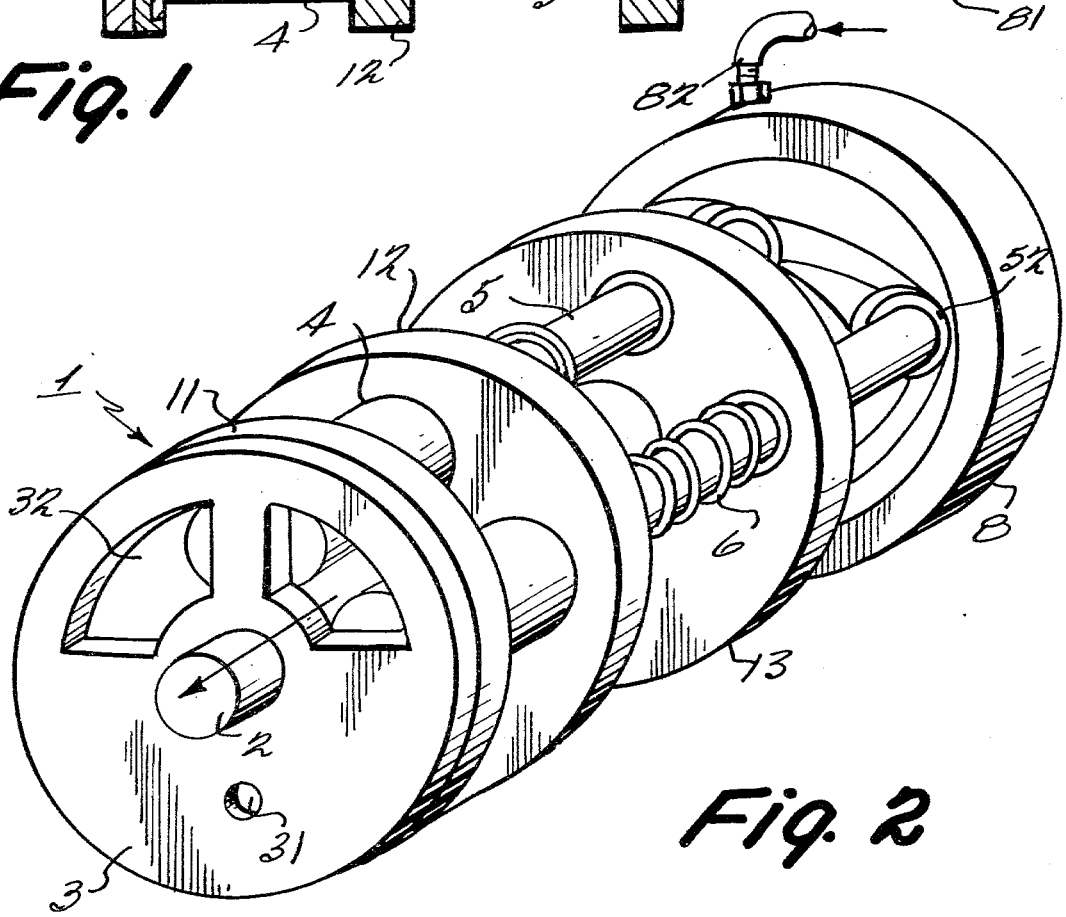
FIG. 2 is a perspective view of the present invention.

On FIGS. 1 & 2, wheel rotor 1 includes one center rod 2 which is the main shaft of the invention engine, four engine cylinders 4 being secured symmetrically on the wheel rotor 1 as the internal-combustion unit of the invention engine. There is one piston 51 in each of the cylinders 4 a piston rod 5 fixed to each piston 51 extends outside cylinder 4, pivoted with a bearing roller 52 at its end to confront against the undulating surface of a substantially saddle-shaped cam 7. Bearing roller 52 allows the piston rod 5 to move easily on the undulating surface of cam 7. Piston rod 5 must be devised such that it is unlikely to be turned inside the cylinder so that the bearing roller 52 is kept rollable (produce no friction) on the undulating surface of cam 7.

On FIGS. 8 & 9, the cam 7 is shown in a view as an irregular cylinder, partly received inside a same-sized oil ditch 83 of base receiver 8. There are an one-way oil supply valve 82 and an oil pressure relief valve 81 placed at the oil ditch 83 to maintain the floating of the cam 7. The oil in oil ditch 83 supplied through supply valve 82 pushes the piston rod 5 together with piston 51 to a maximum inward position to thereby obtain an utmost compression ratio of gas in the cylinder. Oil pressure relief valve 81 relieves any excessive oil pressure whenever the compression pressure of cylinder 4 is at a level that the cylinder structure will be unable to withstand. Both of two valves 82 and 81 function to automatically control the compression ratio of gas in the combustion chamber.

Wheel rotor 1 can be divided into three parts (11, 12 and 13). The cylinders are secured between the part 11 and the part 12, the part 11 being bored with openings for matching with the top ports of the cylinders 4. Part 12 and part 13 are also bored with holes positioned for being penetrated by piston rods 5. Springs 6 resides around each piston rod 5 against the part 12. Main shaft 2 penetrates side housing 3, side housing 3 being bored with three openings including spacing hole 31, intake port 32 and exhaust port 33. Base housing 3 covers wheel rotor 1 with a small gap 58 being formed between housing 3 and wheel rotor part 11.

FIGS *4a*, *4b* and 5 show that the top port of the cylinder 4 is smaller than the opening of the part 11 of wheel rotor 1 to enable one set of ring packings 54, 55, 56 & 57 to be placed into the opening and against the cylinder 4. Ring packings 54, 55 & 56 close together to prevent possible leakage of gas through the ring ends, and one undulating ring 57 operates as a spring washer leaning against the inner wall of cylinder 4 pushing the ring packings 54, 55 & 56 outward tightly onto the side housing 3. The packings 54, 55, 56 & 57 function importantly so that the wheel rotor 1 may have a slight spacing 58 from the side housing 3 for avoiding friction produced by revolution, the packings 54, 55, 56 & 57 maintaining contact with side housing 3 to ensure no leakage happens between the cylinder 4 and the side housing 3. Piston 51 is equipped with oil ring 511 and piston ring 512 as packings for preventing gas leakage from piston 51 and maintaining the compression pressure during piston travel.

Referring again to FIGS. 7, 8 & 9, post 71 dovetails through the base receiver 8 into an indented portion 711 of the cam 7 to act as a stopper for restricting the retractability of cam 7 to a fixed range.

On FIG. 3, the piston rod 5 confronts against the undulating surface of the substantially saddle-shaped cam 7. The surface of the cam 7 appears in two peaks and two valleys opposing each other across the cam.

When one cylinder 4 revolves from the position A where piston rod 5 leaves one peak of the cam 7 and makes the piston 51 leave its maximum inward position as the power stroke occurs, the expanding gas pushes piston rod 5 outward and the piston rod 5 together with the cylinder 4 are caused to move along a slope down to a valley of the cam surface, the cylinder revolving to the position B.

At position B, where piston rod 5 falls to a valley of the cam 7, the piston 51 is at its maximum outward position. The revolution of the cylinder from position A to B produces work, so that phase may be called a work-phase.

For the duration of the period during which the cylinder continues to revolve and the piston rod 5 clambers up to another peak of the cam 7, the top port of cylinder 4 moves in the zone of the exhaust opening 33, and the piston rod 5 gradually pushes the piston inward to expel the burned gas out through the exhaust opening 33 to the atmosphere. When cylinder 4 revolves to the position C, the "exhaust" is completed.

As cylinder 4 continues to revolve past position C and makes the top port of cylinder 4 move in the zone of intake opening 32, the piston rod 5 moves gradually down to another valley of the cam 7, so that piston 51 moves outward and inducts gas through intake port 33 into the combustion chamber of the cylinder 4. When cylinder 4 finally revolves to the position D, the top port of cylinder 4 is shut off and the "intake" is completed.

As cylinder 4 continuously revolves past position D and the piston rod 5 gradually clambers up to the first peak of the cam 7, piston 51 moves inward, and while near the upper limit of the piston travel (or top dead center), the top port of the cylinder 4 matches the spacing hole 31 and fuel will then spray into the combustion chamber of the cylinder 4 (if a diesel engine employed) and the "ignition" spontaneously happens (irrespective of whether it is a compression-ignition or a spark-ignition engine). When the cylinder revolves passing the position A the "power stroke" is repeated.

From positions B to C, C to D and D to A, the pistons and cylinder 4 do not work, so these phases may be called nonwork-phases. What is described above is one single cylinder moving in one circle of revolution and with one work-phase (one fourth of the circle). If four cylinders are secured symmetrically around the wheel rotor 1, each cylinder will successively work during one fourth of a revolution and make the overall engine of the present invention work continuously during the whole of each circle revolution. Therefore, when more than four cylinders are employed in the engine of the present invention more than one cylinder will be placed in a power stroke in the work-phase (on average, 1.25 cylinder working if 5 cylinders employed and 2 cylinders in the work-phase if 8 cylinders employed) and a larger output will be produced. Moreover, the more cylinders are used, the more continuous will be the level of output.

I claim:

1. Internal combustion engine comprising:

a wheel rotor having a longitudinal axis of rotation;

at least one internal combustion cylinder secured upon said rotor parallel to said longitudinal axis such that said at least one cylinder revolves with said rotor;

said at least one cylinder having an internal combustion chamber, and a top port communicating with said chamber and a piston and piston rod reciprocally moveable in said chamber;

a side housing disposed in confronting relation with the top port of the combustion chamber of said at least one cylinder, said housing having three openings including an intake port, an exhaust port and an aperture for functionally receiving a combustion promoting device, said three openings being positioned in functional relation to said at least one cylinder for respectively receiving gas into said chamber, evacuating burned gas from said chamber and communicating with said gas in said chamber to promote ignition thereof, as said cylinder revolves across the respective openings;

a substantially saddle-shaped circular cam having a top undulating surface confronting said piston rod such that said piston rod reciprocates against said surface causing said at least one cylinder to revolve; and oil base receiver means for cushioning said cam when said piston rod reciprocates thereon, said cushioning means including a receiver member having a closed circular channel formed therein for closely receiving said circular cam, said receiver member further comprising a oneway oil supply valve for supplying oil to said channel and an oil pressure relief valve connecting to said channel so as to automatically control the pressure of said oil, thereby automatically controlling the combustion ratio of gas in said combustion chamber.

2. The internal-combustion engine as claimed in claim 1 wherein each of said at least one cylinder includes: one top port packed with packings tightly onto said side housing for preventing possible leakage of gas from the combustion chamber of said at least one cylinder when said at least one cylinder revolves, said piston rod extending outside said at least one cylinder to confront against said undulating cam surface, said piston rod having a bearing roller means, disposed at the end of said piston rod directly on said undulating cam surface, for reducing friction generated between said piston rod and said undulating cam surface.

3. The internal combustion engine of claim 1 further comprising a fuel injection nozzle disposed at said aperture for injecting fuel into said combustion chamber to promote ignition thereof during compression.

4. Internal combustion engine as in claim 1 wherein said receiver member includes a stopper element extending into said channel, said cam having an indented portion, said indented portion receiving said stopper element so as to restrict the longitudinal movement of said cam into said channel to a range defined by the boundaries of said indented portion.

* * * * *